United States Patent [19]

Brieseck et al.

[11] Patent Number: 4,635,881

[45] Date of Patent: Jan. 13, 1987

[54] FOLDABLE WING, ESPECIALLY FOR A PROJECTILE

[75] Inventors: Bernd Brieseck, Henfenfeld; Peter Kreuzer, Zirndorf-Weiherhof, both of Fed. Rep. of Germany

[73] Assignee: Diehl GmbH & Co., Fed. Rep. of Germany

[21] Appl. No.: 764,314

[22] Filed: Aug. 9, 1985

[51] Int. Cl.[4] ..... B64C 3/56

[52] U.S. Cl. ..... 244/49; 244/3.24; 244/3.27

[58] Field of Search ..... 244/49, 3.24, 3.27, 244/3.28, 3.29, 218

[56] References Cited

U.S. PATENT DOCUMENTS 2,810,985 10/1957 Bilder ..... 244/49

4,106,727 8/1978 Ortell ..... 244/49

*Primary Examiner*—Trygve M. Blix

*Assistant Examiner*—Mark R. Valliere

*Attorney, Agent, or Firm*—Scully, Scott, Murphy & Presser

[57] ABSTRACT

A foldable wing or airfoil, which is especially but not exclusively adapted for a projectile, and which incorporates interengaging telescopable fin sections. A nose in the foldable wing, which is hingable in the region of one end through a pivot in a longitudinal groove, has a chamber opening facing away from its leading edge and which is located between the wing part surfaces for receiving the interlocking fin sections, which sections are profiled in U-shaped configuration. The chamber also receives a base or root spar which is hinged in the region of its leading end in the chamber, and wherein the front ends of the fin sections straddle the root spar and are each hinged along the root spar offset relative to each other.

13 Claims, 4 Drawing Figures

FOLDABLE WING, ESPECIALLY FOR A PROJECTILE

BACKGROUND OF THE INVENTION

1. Field of the Invention

The present invention relates to a foldable wing or airfoil, which is especially but not exclusively adapted for a projectile, and which incorporates interengaging telescopable fin sections.

2. Discussion of the Prior Art

A foldable wing or airfoil having fin sections engaging so as to be telescopically retractable into one another is disclosed in U.S. Pat. No. 4,364,531. In that instance, the foldable wing consists substantially of a front segment and a rearward segment hinged together and held opposite each other in a sliding guide extending along the outer wall of a fuselage or airborne body. The fin sections extend between the front segment and the outer wall of the body, interengaging transversely of the longitudinal axis thereof. For effecting expansion of the wing, with the segments initially abutting extended along the fuselage, a balloon located within the box-shaped fin sections is inflated from a gas supply; so as to, through the super-pressure produced in the interior, urge the box-shaped fin sections apart and thereby extend the jointed segments from the fuselage until the appropriately profiled leading edge of the rear segment, upon erection thereof, will in a rectilinear manner seal the extended fin sections along the trailing wing side. A configuration having shaped fin sections which are expanded transversely of the longitudinal axis of the projectile by internally generated superpressure for effecting the lateral movement of the segments which are initially extended along the projectile fuselage is, however, extremely space-consuming. Moreover, the freedom of the foldable wing from any interference during expansion of the wing is not completely satisfactory inasmuch as, shortly prior to the positioning of the rear segment in the final position there, there are encountered unfavorable force-introduction lever ratios, and the procedure of engaging into the operational position is additionally hindered by the increasing dynamic pressure acting on the front segment.

Even more space-consuming is the construction of the folding airfoil system disclosed in U.S. Pat. No. 4,106,727. The fin sections or channels which interlock or telescopingly interengage pairedly represent the lengthier or longitudinal sides of acute-angled triangles, the applicable bases of which triangles are defined by the expanse or extent between the channel hinges in the fuselage of the airborne body. In order to satisfy the required kinematics, it is necessary to provide sliding guides between the interlocking or interengaging channels or fin sections, (which guides are prone to operational problems) in the regions of the apex of the triangle opposite the base. The lengthy overlapping channels generate high friction moments during the unfolding of the airfoil or wing; with kinematically unfavorable forces being introduced therein during the unfolding through an adjusting member; thereby necessitating the provision of considerable additional space in the airborne body fuselage or projectile behind the channel hinges.

SUMMARY OF THE INVENTION

In recognition of these shortcomings, it is an object of the present invention to provide a foldable wing, which can be assembled relatively simply, requires only relatively little installation space, and which can be extended in an operationally-dependent manner in a mode which is kinematically satisfactory.

According to the present invention there is provided a foldable wing, for example for a projectile, possessing telescopably interlocking fin sections for extension and erection of the wing surface, and wherein a nose in the foldable wing, which is hingable in the region of one end through a pivot in a longitudinal groove, has a chamber opening facing away from its leading edge and which is located between the wing part surfaces for receiving the interlocking fin sections, which sections are profiled in U-shaped configuration. The chamber also receives a base or root spar which is hinged in the region of its leading end in the chamber, and wherein the front ends of the fin sections straddle the root spar and are each hinged along the root spar offset relative to each other.

Additionally, pursuant to the present invention there is provided a projectile or airborne body incorporating at least one foldable wing, with the wing having a nose spar, a root spar and overlapping interengaging fin sections which are pivotally connected along the root spar. The arrangement is such that the wing is retracted within the projectile in a folded condition, with the fin sections sequentially enveloping or nesting within each other in a groove in the projectile or airborne body, and with the wing being extendable through the nose spar being pivoted outwardly from the groove, thereby pivoting the fin sections relative to the root spar and unfolding the fin sections from each other and from the nose spar into a locking position in which the shape of the wing is defined in part by the fin sections.

The individual fin sections may be swung out, opposite the folding movement of the nose spar, in a manner to that of unfolding a fan; in essence, about pivot axes which are located mutually offset along the root spar (which itself is pivoted out of the nose spar). In this manner the wing can be separately assembled and tested; and the installation thereof in a projectile or airborne body fuselage requires only one pivot hinge for the nose spar about which there acts a force (for example, a torsion spring). The fin sections, which in themselves define the wing trailing edge, increasingly shorten in their rearward succession, from which there are obtained correspondingly short telescoping (straddling) overlaps, and as a result low outward pivoting friction moments.

BRIEF DESCRIPTION OF THE DRAWINGS

Additional alternatives and modifications as well as further features and advantages of the present invention will become readily apparent from the following description of a preferred exemplified embodiment of a foldable wing in accordance with the present invention; having reference to the accompanying drawings which are approximately true to scale; in which.

DETAILED DESCRIPTION

Figure 1:
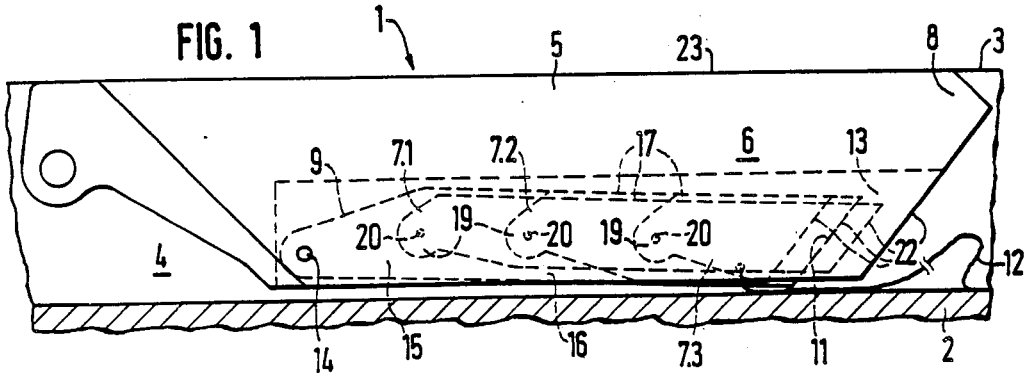
FIG. 1 shows the inventive foldable wing in its retracted position within the outer contour of a projectile body.

FIG. 1, a projectile or airborne body 1, shown in an axial longitudinal fragmentary section has, a longitudinal groove 4 in its body 2 opening towards the outside of the wall 3, which groove 4 is adapted to receive a foldable wing 5 in its retracted condition.

Figure 2:
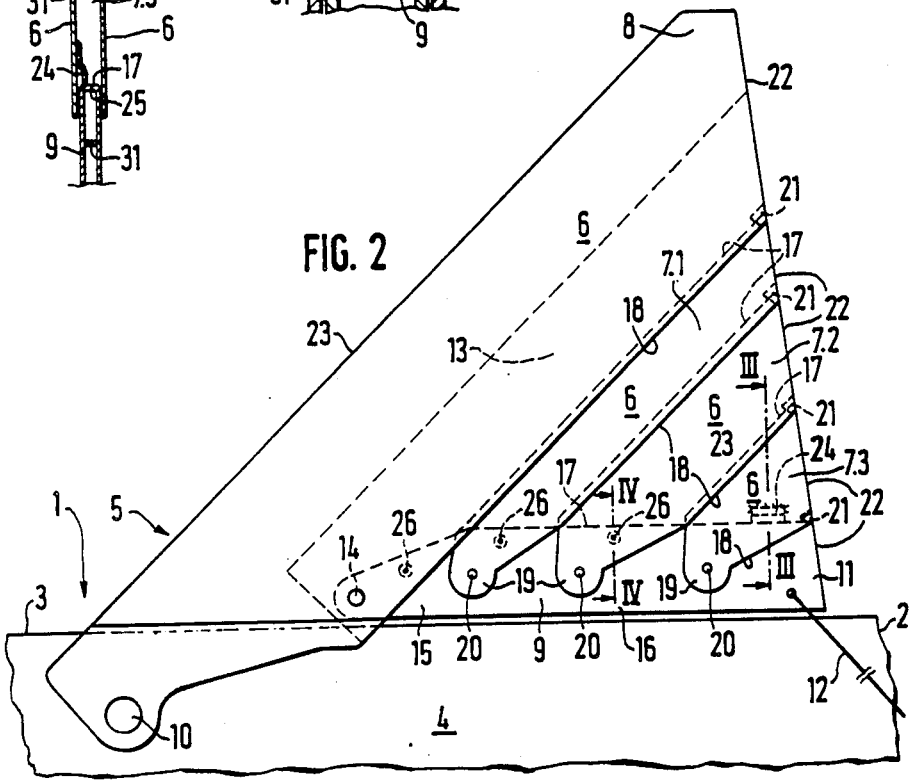
FIG. 2 shows the foldable wing of FIG. 1 in the extended or erected position thereof.

As is more apparent from FIG. 2, the wing surface 6 is constituted of overlapping or telescopically interengageable fin sections 7 which are arranged between a nose spar 8 and a base or root spar 9. The wing 5 is extended by pivoting the nose spar 8 outwardly about hinge pivot 10 so as to draw the wing from the longitudinal groove 4 and thereby expand the wing from its retracted or folded-together condition in a manner similar to that of unfolding a fan. In order to maintain the wing erect in this extended position, a traction wire 12 is fastened in the region of the trailing end 11 of the root spar 9, hinged oppositely to the nose spar 8. The other end of the wire 12 is secured to the projectile body 2 (for example, to the bottom of the longitudinal groove 4) and is tensioned when an outward biasing torque or moment acts on the hinge pivot 10.

For the reception of the fin sections 7 and of the root spar 9 when the wing 5 is retracted, the nose spar 8 is provided with a rearwardly facing receiving chamber 13 which is profield substantially in a U-shaped cross-section and which is open towards the projectile fuselage 2 and formed between its wing surfaces 6 on both sides thereof. In the telescoped condition, the fin sections 7 sequentially envelop each other or nest within one another. As shown in FIG. 2, the leading end 15 of the root spar 9 is connected to the nose spar 8 through a hinge connection 14 which is provided at the innermost end of the chamber 13.

In the region of the rear or trailing end 11, the root spar 9 is straddled by a relatively short U-shaped lower fin section 7.3. The upper edge of the fin section 7.3 is straddled by a central, somewhat longer fin section 7.2 which also straddles the central portion 16 of the root spar 9. The upper edge of fin section 7.2 is straddled by the longest fin section 7.1, the latter of which also straddles a part of the front end 15 of the root spar 9. The upper edge of fin section 7.1 is straddled by the side walls of the chamber 13 of the nose spar 8, the latter of which also straddles the front or leading end 15 of the root spar 9. In the erect or extended position of the wing 5, the overall wing surface 6 thereof is thus constituted of the series of the fin sections 7, each projecting from the other, and in each case straddled at their inclined upper edges 17, as well as consisting of a part of the nose spar 8 (with the greatest lateral dimension) and of the root spar 9 (least lateral dimension); the three-dimensional curved configuration of the individual partial wing surfaces 6 with the exception of the flat, lower edges 18, so as to in its entirety form the desired aerodynamic geometry for the extended foldable wing 5.

For effecting extension of this overall wing surface 6, as shown in FIG. 2, the individual fin sections 7 are each hinged in the region of their innermost front ends 19 through pivots 20 to the root spar 9. Engaging projections 21, (not shown in detail in the drawings) which are provided at the inclined upper or leading edges 17 and lower or trailing edges 18 proximate the rear edges 22 cause, due to a mutual form-fitted engagement, the formation of a continuous closed rear edge (consisting of all the rear or trailing edges 22 shown in FIG. 2) of the foldable wing 5. Upon the tensioning of the traction cable 12 resulting from the nose spar 8 being pivoted out of the longitudinal groove 4 in the projectile, and thus as a result of the root spar 9 pivoting out of the chamber 13; from the uppermost located fin section 7.1 to the innermost fin section 7.3, the fin sections 7 are successively pivoted telescopically out of the projectile body 2 about their hinge connections 20; until upon the mutual abutment of all of the projections 21, there is formed the closed rear or trailing edge of the foldable wing 5.

Leaf springs 24 may be provided to form latching members (detents) which will restrain the fin sections from folding back into each other; for instance, due to dynamic pressure acting against the leading edge 23 of the wing. The leaf springs 24 may be arranged in the interiors of the fin sections 7, engaging over the adjoining fin sections 7 or the root spar 9; although other types of latching members may also be provided. The springs 24, in the retracted condition of two adjacent fin sections 7, lie between the adjacent wall surfaces thereof, such that in the final completely extended position of a fin section 7.3 (FIG. 3), the springs 24 will engage behind the adjacent edge 17; in essence, the region of the yoke 25 of the U-shaped structure, for example that of the root spar 9, and support that edge 17 secured against the fin section 7.2 located in front thereof; and in a similar manner, subsequently the remaining fin sections against the nose spar 8.

Figure 4:
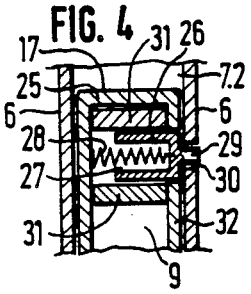
FIG. 4 shows a sectional view taken along line IV—IV in FIG. 2, represented on a larger scale than FIG. 3.

However, when a larger installation space is available for the latching members in a direction transverse of the wing surface 6 (such as in the region of the front ends 19 of the fin sections which are located further forwardly and, accordingly because of the fin sections 7 straddling each other, protrude further from the central plane of the root spar 9) it is more expedient to construct the latching members in the form of index pins 26 (FIG. 4). These pins 26 can be arranged to support the erected extended wing to resist greater forces, since there is little danger of buckling or of engagement between adjacent fin sections 7. The index pins 26 are axially displaceable in the root spar 9, for example, between ribs 31, and are supported against a compression spring 28 which is located in a longitudinal bore 27. The stepped end 29 is thus engaged in a spring-loaded manner into a bore 30 in the fin section 7 (possibly also in the nose spar 8), as soon as there has been reached the desired extended angular position relative to the root spar 9.

Figure 3:
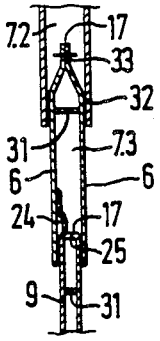
FIG. 3 shows a sectional view taken along line III—III in FIG. 2, but with transverse dimensions shown to a larger than actual scale.

The individual fin sections 7, as well as the root spar 9 (and under certain circumstances also the nose spar 8) are of U-shaped sheet metal construction with the yokes 25 facing towards the edges 17, 23, and may be provided with stiffening ribs 31 between the segments 32 which make up the wing surfaces 6. Edges 17 may be bevelled edges provided on a unitary sheet, as indicated in FIG. 3 for the root spar 8; or alternatively constructed from individual curved sheets which are connected together along the edges 17 (for example, through spot-welded connections 33) as indicated in FIG. 3 for the smallest fin section 7.3.

The term telescopically is employed throughout the specification as a broad general term to define any interengaging relationship in which parts may be relatively displaced further into and out of each other.

What is claimed is:

1. A foldable wing, such as for a projectile, including telescopically interengageable fin sections for the erection of an extended wing surface; a nose spar hinged proximate one end by a pivot in a longitudinal groove in the projectile, said nose spar having a chamber opening away from the leading edge thereof located between the wing part surfaces for receiving the interengaged fin sections, said fin sections being profiled in a U-shaped cross-section and said fin sections being of different lengths which progressively shorten towards the trailing end of the projectile, said chamber receiving a root spar which is hinged proximate its front end in the chamber, and the front ends of the fin section straddling the root spar and being hinged along the root spar offset relative to each other.

2. A foldable wing as claimed in claim 1, wherein leading edges of the fin sections and of the root spar, and the trailing edges of the fin sections and of the nose spar include engaging projections in the region of their rear edge which form-fittingly cooperate in pairs.

3. A foldable wing as claimed in claim 1, wherein a traction cable is connected between the region of the trailing end of the root spar and a longitudinal groove.

4. A foldable wing as claimed in claim 1, wherein detents are arranged between the fin section and the nose spar and the adjacent leading edges of the fin sections and the root spar.

5. A foldable wing as claimed in claim 4, wherein said detent comprises a leaf spring arranged between the segments of at least one U-shaped fin section.

6. A foldable wing as claimed in claim 4, wherein in the root spar comprise index pins for engagement in bores in the segments of the U-shaped fin sections and of the nose spar.

7. A foldable wing as claimed in claim 6, wherein each index pin comprises a compression spring which engages into a longitudinal bore.

8. A foldable wing as claimed in claim 1, wherein the profiles of the fin sections and of the root spar and of the nose spar are formed by a bevelled sheet with segments extending in conformance with the desired wing surface.

9. A foldable wing as claimed in claim 1, wherein the profiles for the fin sections and for the root spar are formed by sheets which are welded together in the region of their upper or leading edges and which are curved in conformance with the desired wing surface.

10. In a projectile or airborne body comprising at least one foldable wing, said wing including a nose spar, a root spar and overlapping interengaging fin sections which are pivotally connected along the root spar, and said fin sections being of different lengths which progressively shorten towards the trailing end of the projectile, the arrangement wherein the wing is retracted in a folded condition with the fin sections sequentially nesting within each other in a groove formed in the projectile or body, the wing being erected by the nose spar being pivoted outwardly from the groove so as to pivot the fin sections relative to the root spar and unfolding the fin sections from one another and the nose spar into an extended latched position in which the wing shape is defined in part by the fin sections.

11. A projectile as claimed in claim 10 in which the fin sections straddle each other.

12. A projectile as claimed in claim 10, wherein the nose spar straddles the fin sections and the root spar when the wing is in the folded retracted position.

13. A projectile as claimed in claim 10, wherein three fin sections are hinged about parallel axes spaced along the root spar.

* * * * *